US009284851B2

(12) United States Patent
Takaoka et al.

(10) Patent No.: US 9,284,851 B2
(45) Date of Patent: Mar. 15, 2016

(54) AXIAL-FLOW FLUID MACHINE, AND VARIABLE VANE DRIVE DEVICE THEREOF

(75) Inventors: Yoshimasa Takaoka, Tokyo (JP); Kazuharu Hirokawa, Tokyo (JP); Hiroki Nishiyama, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 797 days.

(21) Appl. No.: 13/610,136

(22) Filed: Sep. 11, 2012

(65) Prior Publication Data

US 2013/0216360 A1 Aug. 22, 2013

(30) Foreign Application Priority Data

Feb. 21, 2012 (JP) ..... 2012-035373

(51) Int. Cl.
*F01D 17/16* (2006.01)
*F01D 17/00* (2006.01)
*F04D 29/56* (2006.01)

(52) U.S. Cl.
CPC ..... *F01D 17/00* (2013.01); *F01D 17/162* (2013.01); *F04D 29/563* (2013.01)

(58) Field of Classification Search
CPC ... F01D 17/00; F01D 17/162; F05D 2240/12; F05D 2250/90; F02C 7/042; F02C 9/20
See application file for complete search history.

(56) References Cited

U.S. PATENT DOCUMENTS 3,841,788 A * 10/1974 Sljusarev et al. ..... 415/147
3,990,809 A * 11/1976 Young et al. ..... 415/160
4,035,101 A * 7/1977 Glenn ..... 415/160
7,128,527 B2 * 10/2006 Jonsson ..... 415/159
7,828,516 B2 * 11/2010 Hartmann et al. ..... 415/151
7,938,620 B2 * 5/2011 Bouru ..... 415/160

(Continued)

FOREIGN PATENT DOCUMENTS

CN 1420258 A * 5/2003 ..... F01D 9/02
CN 201180686 Y 1/2009
JP 61-021840 U 2/1986

(Continued)

OTHER PUBLICATIONS

English macnine translation of JP 2654196 equivalent of JP 3-100336, translated by Japan Platform for Patent Information on Jul. 21, 2015.*

(Continued)

*Primary Examiner* — Craig Kim
*Assistant Examiner* — Wayne A Lambert
(74) *Attorney, Agent, or Firm* — Westerman, Hattori, Daniels & Adrian, LLP

(57) ABSTRACT

In a variable vane drive device of an axial-flow fluid machine, a ring support unit supporting a movable ring includes: a first roller; a first support part supporting the first rollers so as to be relatively immovable with respect to a vane holding ring in a radial direction and in an axial direction; a second roller; a second support part supporting the second roller so as to be relatively movable with respect to the vane holding ring in the radial direction and pressing the second roller in the radial direction; a third roller allowing relative movement of the movable ring in the radial direction and restricting relative movement of the movable ring in the axial direction; and a third support part supporting the third roller so as to be relatively immovable with respect to the vane holding ring in the axial direction and in the radial direction.

12 Claims, 9 Drawing Sheets

(56) References Cited

U.S. PATENT DOCUMENTS

| | | | | |
|---|---|---|---|---|
| 2012/0051891 | A1* | 3/2012 | Sarri et al. | 415/160 |
| 2013/0108415 | A1* | 5/2013 | Hashimoto et al. | 415/150 |

FOREIGN PATENT DOCUMENTS

| | | | |
|---|---|---|---|
| JP | 63-215843 | A | 9/1988 |
| JP | 63-151999 | U | 10/1988 |
| JP | 3-100336 | A | 4/1991 |
| JP | 2010-001821 | A | 1/2010 |

OTHER PUBLICATIONS

International Search Report of PCT/JP2012/073358, date of mailing Nov. 13, 2012, with Written Opinion.

Office Action dated Nov. 4, 2015, issued in conterpart Chinese Patent Application No. 201280069684.X, with English translation. (10 pages).

* cited by examiner

AXIAL-FLOW FLUID MACHINE, AND VARIABLE VANE DRIVE DEVICE THEREOF

TECHNICAL FIELD

The present invention relates to an axial-flow fluid machine including a rotor at which a plurality of blades is installed and a variable vane, and a variable vane drive device thereof.

This application claims priority to and the benefit of Japanese Patent Application No. 2012-035373 filed on Feb. 21, 2012, the disclosures of which are incorporated by reference herein.

BACKGROUND ART

In a gas turbine or a turbo refrigerator, an axial-flow compressor, which is one type of axial-flow fluid machinery, is used to compress a gas. This type of axial-flow fluid machine includes a plurality of variable vanes disposed around a rotor in an annular shape, and a variable vane drive device configured to change directions of the variable vanes.

For example, as disclosed in the following Patent Document 1, a variable vane drive device includes a movable ring, a ring support unit, an actuator, and a link unit. The movable ring is disposed at an outer circumferential side of a vane support ring (a casing) and has an annular shape. The ring support unit rotatably supports the movable ring. The actuator rotates the movable ring. The link unit connects the movable ring to the plurality of variable vanes. The ring support unit has two first rollers and one second roller. The first rollers are disposed at an outer circumferential side of the movable ring, which is the lower side of the vane support ring, at an interval in a circumferential direction of the movable ring. The second roller is disposed at an inner circumferential side of the movable ring, which is the lower side of the vane support ring, at an interval from the two first rotors in the circumferential direction of the movable ring.

The two first rollers support the movable ring from a lower side thereof, and restrict downward movement of the movable ring. The one second roller is pressed downward by a spring, and presses the movable ring downward. That is, the second roller presses the movable ring in a direction in which the movable ring approaches the first rollers, and secures a contact pressure between the movable ring and the first rollers.

In the axial-flow compressor, a pressure of a gas gradually increases as it flows to the downstream side, and a temperature of the gas increases. For this reason, a temperature difference is generated between an inside and an outside of the vane support ring during a startup process and a shutdown process of the axial-flow compressor, and a thermal expansion difference is generated between the vane support ring and the movable ring disposed at the outer circumferential side of the vane support ring. For this reason, in the variable vane drive device disclosed in Patent Document 1, only a lower portion of the movable ring is supported by the first rollers and the second roller. In addition, with an upper side of the movable ring being in a free state, even when the movable ring thermally expands to relatively increase a diameter of the movable ring with respect to a diameter of the vane support ring, an upper portion of the movable ring can move upward.

Related Art Document

Patent Document

[Patent Document 1] Japanese Unexamined Patent Application, First Publication No. 2010-1821

SUMMARY OF THE INVENTION

Problems to be Solved by the Invention

In the variable vane drive device disclosed in Patent Document 1, even when a thermal expansion difference occurs between the vane support ring and the movable ring, expansion of the movable ring is released upward. For this reason, the movable ring can be smoothly rotated without overload applied to the support of the movable ring.

In addition, in the variable blade drive device, it is desired that a direction of each of the plurality of variable vanes is changed by a target vane angle by rotation of the movable ring.

Therefore, the present invention provides an axial-flow fluid machine capable of securing smooth rotation of a movable ring and setting a variable vane to a target vane angle, and a variable vane drive device thereof.

Means for Solving the Problems

In order to accomplish the above-mentioned objects, a variable vane drive device of an axial-flow fluid machine according to the present invention includes a movable ring which is in an annular shape and provided along an outer circumferential side of a plurality of variable vanes disposed annularly; a vane holding ring which encloses the outer circumferential side of the plurality of variable vanes and holds the plurality of variable vanes; a ring support unit which rotatably supports the movable ring with respect to the vane holding ring; and a driving force transmission unit which connects the movable ring and the plurality of variable vanes in such a way that an angle of the plurality of variable vanes is changed by rotation of the movable ring, wherein the ring support unit comprises: a plurality of first rollers which makes a rolling contact with the movable ring; a first support part which supports the first rollers so as to be relatively immovable with respect to the vane holding ring in a radial direction and in an axial direction of the vane holding ring; one or more second rollers which make rolling contact with the movable ring; a second support part which supports the second rollers so as to be relatively movable with respect to the vane holding ring in the radial direction, and pressing the second rollers in the radial direction toward a side at which the movable ring is pressed against the first roller; one or more third rollers which are disposed in such a way that a space is secured between the third rollers and the movable ring in the radial direction, allow relative movement of the movable ring in the radial direction, and restrict relative movement of the movable ring in the axial direction; and a third support part which supports the third rollers so as to be relatively immovable with respect to the vane holding ring in the axial direction and the radial direction.

In the variable vane drive device according to an aspect of the present invention (hereinafter referred to as a variable vane drive device of the present invention), the second roller and the third roller allow relative movement of the movable ring in the radial direction. Further, since the second roller is pressed by the second support part to press the movable ring against the first roller, a contact between the respective rollers and the movable ring is secured. Accordingly, even when a thermal expansion difference between the vane holding ring and the movable ring occurs and a difference between change in a diameter of the vane holding ring and change in a diameter of the movable ring due to thermal expansion occurs, it is possible to avoid situations in which, for example, the change in the diameter of the vane holding ring by expansion becomes larger than the change in the diameter of the movable ring and an overload is applied to the ring support unit rotatably supporting the movable ring, or conversely, the change in the diameter of the vane holding ring by contraction becomes larger than the change in the diameter of the movable ring and the movable ring comes off from the ring support unit. Accordingly, the movable ring can be stably and smoothly rotated.

In addition, in the variable vane drive device of the present invention, even when a difference between the change in the diameter of the vane holding ring and the change in the diameter of the movable ring due to thermal expansion occurs and the movable ring relatively moves with respect to the third roller in the radial direction, relative movement of the movable ring with respect to the third roller in the axial direction can be restricted.

That is, in the variable vane drive device of the present invention, the second support part supporting the second roller absorbs the thermal expansion of the movable ring in the radial direction by allowing movement of the movable ring in the radial direction, and the third roller and the third support part supporting the third roller restrict displacement of the movable ring with respect to the vane holding ring in the axial direction. Accordingly, the movable ring moves only in the radial direction and does not move in the axial direction.

Here, if the movable ring moves in the axial direction, since a distance in the axial direction between the movable ring and the respective variable vanes is changed and a state of the driving force transmission unit configured to connect the movable ring and the variable vane is changed, the respective variable vanes cannot be set to a target vane angle. However, in the variable vane drive device of the present invention, as described above, since movement of the movable ring in the axial direction is restricted by the third roller, a distance in the axial direction between the movable vane and the movable ring can be maintained and the variable vanes can be set to the target vane angle.

In the variable vane drive device of the axial-flow fluid machine, a protruding part protruding from one of the third rollers and the movable ring to the other one may be formed at one of the third rollers and the movable ring, a pair of flange parts sandwiching the protruding part in the axial direction may be formed at the other one of the third rollers and the movable ring, a pair of side surfaces of the protruding part directed to the axial direction may form surfaces perpendicular to the axial direction, and the pair of flange parts formed at the other one may have a pair of surfaces facing each other and perpendicular to the axial direction.

In the variable vane drive device of the present invention, relative movement of the movable ring with respect to the third roller in the radial direction is allowed, and relative movement of the movable ring with respect to the third roller in the axial direction is securely restricted.

In addition, in the variable vane drive device of the axial-flow fluid machine, the first rollers may be configured to restrict relative movement of the movable ring in the axial direction.

In the variable vane drive device, since relative movement of the movable ring with respect to the first roller in the axial direction can be restricted, movement of the movable ring in the axial direction can be restricted in a plurality of places. For this reason, in the variable vane drive device, a distance in the axial direction between the movable ring and the respective variable vanes can be substantially uniformized, and the plurality of variable vanes can be substantially uniformly set to a target vane angle.

In addition, in the variable vane drive device of the axial-flow fluid machine, the second roller may be configured to restrict relative movement of the movable ring in the axial direction, and the second support part may support the second rollers so as to be relatively immovable with respect to the vane holding ring in the axial direction.

In the variable vane drive device, since relative movement of the movable ring with respect to the second roller in the axial direction can be restricted, movement of the movable ring in the axial direction can be restricted at a plurality of places. For this reason, also in the variable vane drive device, a distance in the axial direction between the movable ring and the respective variable vane can be substantially uniformized, and the plurality of variable vanes can be substantially uniformly set to a target vane angle.

In addition, in the variable vane drive device of the axial-flow fluid machine, when the vane holding ring is equally divided into a first region and a second region in a circumferential direction, the plurality of first rollers may be disposed at an outer circumferential side of the first region, and the third rollers may be disposed at an outer circumferential side of the second region.

In the variable vane drive device, when a difference between the change in the diameter of the vane holding ring and the change in the diameter of the movable ring due to thermal expansion occurs, as the plurality of first rollers is disposed unevenly at an outer circumferential side of the first region, a portion of the movable ring moving with respect to the vane holding ring in the radial direction can be shifted to the side of the third roller disposed at the outer circumferential side of the second region. For this reason, in the variable vane drive device of the present invention, when a difference between the change in the diameter of the vane holding ring and the change in the diameter of the movable ring due to thermal expansion occurs, movement of the movable ring in the axial direction according to the difference of change in the diameter can be efficiently restricted by the third roller.

Further, in the variable vane drive device of the axial-flow fluid machine, two first rollers may be provided, a first one of the two first rollers may be disposed at one side of the first region in a circumferential direction thereof, and a second one of the two first rollers may be disposed at the other side of the first region in the circumferential direction.

In the variable vane drive device of the present invention, since the first rollers are disposed at the both end sides of the first region and the two first rollers are spaced apart from each other, movement of the movable ring with respect to the vane holding ring in the radial direction can be efficiently restricted.

In addition, in the variable vane drive device of the axial-flow fluid machine, two second rollers may be provided, a first one of the two second rollers may be disposed at one side of the second region in a circumferential direction thereof, and a second one of the two second rollers may be disposed at the other side of the second region in the circumferential direction.

In the variable vane drive device of the present invention, a direction in which the movable ring is pressed by the two second rollers can be stabilized.

In addition, in the variable vane drive device of the axial-flow fluid machine, the third roller may be disposed in the second region and on an extension line of a line of action of resultant force of supporting forces of the plurality of first rollers with respect to the movable ring in the radial direction.

In the variable vane drive device of the present invention, since movement in the axial direction of the movable ring at a portion in which displacement in the radial direction of the movable ring with respect to the first roller is maximized can be restricted by the third roller, movement of the movable ring in the axial direction according to the difference between the change in the diameter of the vane holding ring and the change in the diameter of the movable ring due to thermal expansion can be efficiently restricted.

In the variable vane drive device of the axial-flow fluid machine, an axis of the vane holding ring may extend in a horizontal direction, the first region may be one region of an upper half region and a lower half region with reference to the axis, and the second region may be the other region of the upper half region and the lower half region with reference to the axis.

In the variable vane drive device of the present invention, since a direction in which relative movement of the movable ring in the radial direction is allowed by a third roller is a vertical direction, deformation of the movable ring due to its own weight can also be allowed.

An axial-flow fluid machine according to another aspect of the present invention (hereinafter referred to as an axial-flow fluid machine of the present invention) for accomplishing the above-mentioned objects includes the variable vane drive device; the vane holding ring; a rotor disposed inside of the vane holding ring and having a rotor main body extending in the axial direction and a plurality of blades provided on an outer circumference of the rotor main body; and the plurality of variable vanes disposed at the outer circumferential side of the rotor main body and one side in the axial direction of the plurality of blades.

Also in the axial-flow fluid machine of the present invention, since the variable vane drive device is provided, smooth rotation of the movable ring can be secured and the variable vane can be set to a target vane angle.

The axial-flow fluid machine may be a compressor that compresses a gas by rotation of the rotor. In addition, the axial-flow fluid machine may be a booster compressor into which a gas compressed by a primary compressor is introduced and in which the gas is further compressed by rotation of the rotor, and the axial-flow fluid machine may comprise a casing which covers the outer circumferential side of the vane holding ring and the outer circumferential side of the movable ring, and has a suction port that sucks the gas compressed by the primary compressor and an ejection port that ejects the gas further compressed by rotation of the rotor.

EFFECT OF THE INVENTION

In the present invention, even when a thermal expansion difference is generated between the vane holding ring and the movable ring and a difference between change in a diameter of the vane holding ring and change in a diameter of the movable ring due to the thermal expansion occurs, smooth rotation of the movable ring can be secured and the variable vane can be set to a target vane angle.

MODES FOR CARRYING OUT THE INVENTION

Hereinafter, an embodiment of an axial-flow fluid machine according to the present invention will be described in detail with reference to the accompanying drawings.

[First Embodiment]

First, the first embodiment of the axial-flow fluid machine according to the present invention will be described with reference to FIGS. 1 to 7.

The axial-flow fluid machine of the embodiment is a booster compressor configured to further compress a gas compressed by a primary compressor.

Figure 1:
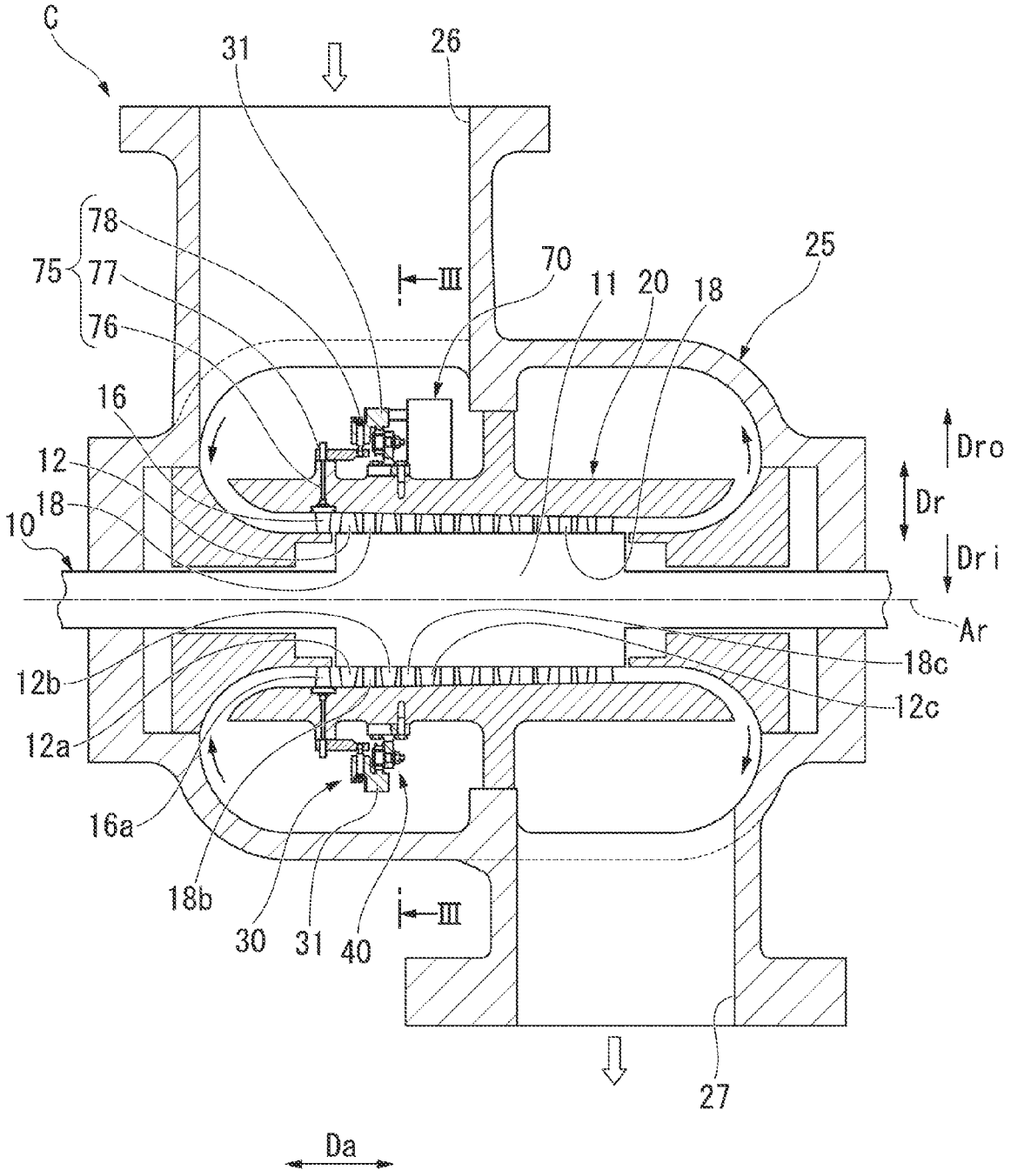
FIG. 1 is a cross-sectional view of an axial-flow fluid machine according to a first embodiment in accordance with the present invention.

As shown in FIG. 1, an axial-flow fluid machine C includes a rotor 10, a pluralities of vanes 16 and 18, a vane holding ring 20, and a casing 25. The rotor 10 has a plurality of blades 12. The pluralities of vanes 16 and 18 are disposed at an outer circumferential side of the rotor 10 in an annular shape at predetermined intervals. The vane holding ring 20 covers the plurality of blades 12 and the pluralities of vanes 16 and 18. The casing 25 covers an outer circumferential side of the vane holding ring 20 and rotatably supports the rotor 10.

The rotor 10 has a rotor main body 11 and the plurality of blades 12. The rotor main body 11 is constituted by stacking a plurality of rotor discs. The plurality of blades 12 extends from each of the plurality of rotor discs in a radial direction of the rotor discs. That is, the rotor 10 has a multi-stage blade structure. The rotor 10 is rotatably supported by the casing 25 around an axis of a rotor main body 11 (hereinafter referred to as a rotor axis Ar). In addition, in the embodiment, the rotor axis Ar extends in a horizontal direction.

Among the plurality of blades 12, the plurality of blades 12 fixed to the rotor disc at the end of one side in an axial direction Da (hereinafter referred to as an upstream side) in which the rotor axis Ar extends constitutes a first blade stage 12*a*. In addition, the plurality of blades 12 fixed to the rotor disc adjacent to the other side (hereinafter referred to as a downstream side) of the rotor disc constitutes a second blade stage 12*b*, and subsequently, the plurality of blades 12 fixed to the respective rotor discs installed at the downstream side constitutes third blade stages 12*c*, and so on.

The pluralities of vanes 16 and 18 are disposed at the upstream side of the blade stages 12*a*, 12*b*, and so on, around the rotor main body 11 in an annular shape. The plurality of vanes 16 disposed at the upstream side of the first blade stage 12*a* constitutes a first vane stage 16*a*. In addition, the plurality of vanes 18 disposed at the upstream side of the second blade stage 12*b* constitutes a second vane stage 18*b*, and subsequently, the plurality of vanes 18 disposed at the upstream side of the respective blade stages 12*c* and so on installed at the downstream side constitutes a third vane stage 18*c* and so on.

In the embodiment, among the vane stages 16*a*, 18*b* and so on, the vanes 16 constituting the first vane stage 16*a* form variable vanes, and the vanes 18 constituting the vane stages 18*b*, 18*c* and so on, which are the second and subsequent vane stages, form stationary vanes. All of the vanes 18 constituting the vane stages 18*b*, 18*c* and so on, which are the second and the subsequent stages, i.e., the stationary vanes, are fixed to an inner circumferential side of the vane holding ring 20. Hereinafter, the vanes 16 constituting the first vane stage 16*a* are simply referred to as variable vanes 16.

A suction port 26 configured to suction a gas compressed by a primary compressor is formed at the outer circumferential side of the upstream side of the casing 25, and an ejection port 27 configured to eject the gas further compressed in the casing 25 is formed at the outer circumferential side of the downstream side.

The axial-flow fluid machine C of the embodiment further includes a variable vane drive device 30 configured to change an angle of the plurality of variable vanes 16. The variable vane drive device 30 includes a movable ring 31, a ring support unit 40, a rotary drive unit 70, and a driving force transmission unit 75. The movable ring 31 is disposed at the outer circumferential side of the vane holding ring 20 and has an annular shape. The ring support unit 40 rotatably supports the movable ring 31 around the rotor axis Ar. The rotary drive unit 70 rotates the movable ring 31 around the rotor axis Ar. The driving force transmission unit 75 connects the movable ring 31 and the variable vane 16 to change the angle of the variable vane 16 by rotation of the movable ring 31.

For example, the rotary drive unit 70 has a straight-moving actuator, and a link unit. The straight-moving actuator straightly drives a rod of the straight-moving actuator. The link unit connects the rod of the straight-moving actuator and the movable ring 31.

Figure 2:
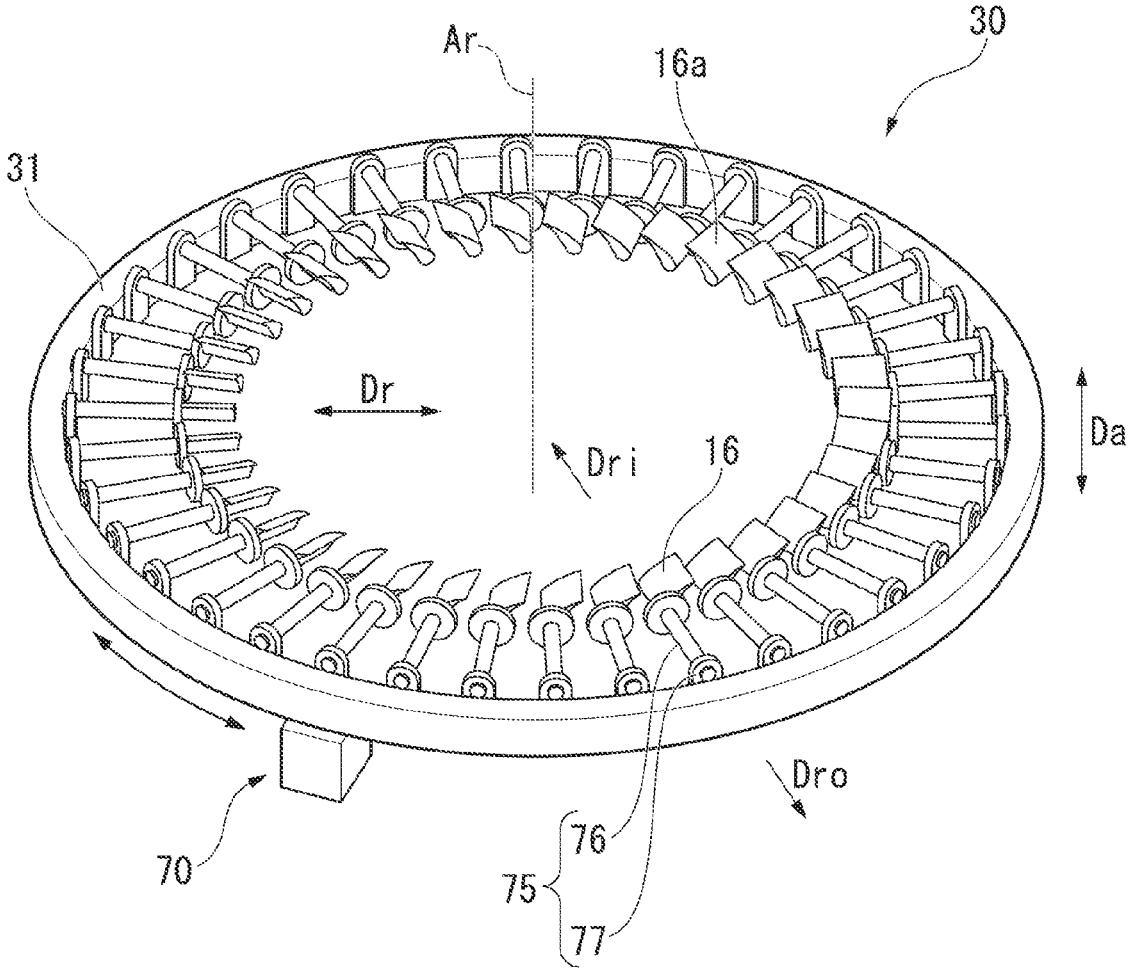
FIG. 2 is a perspective view of a variable vane drive device according to the first embodiment in accordance with the present invention.

As shown in FIGS. 1 and 2, the driving force transmission unit 75 includes a vane rotary shaft 76, a link piece 77, and a connecting pin 78. The vane rotary shaft 76 passes through the vane holding ring 20 from the inside in the radial direction Dri to the outside in the radial direction Dro with respect to the rotor axis Ar, and the variable vane 16 is fixed to an end of the inside in the radial direction Dri of the vane rotary shaft 76. The link piece 77 and the connecting pin 78 connect the movable ring 31 and the vane rotary shaft 76. The link piece 77 is fixed to an end of the outside in the radial direction Dro of the vane rotary shaft 76. The connecting pin 78 connects the link piece 77 and the movable ring 31. The link unit having the link piece 77 and the connecting pin 78 is a unit configured to change an angle of the variable vane 16 by rotating the vane rotary shaft 76 through rotation of the movable ring 31.

Figure 3:
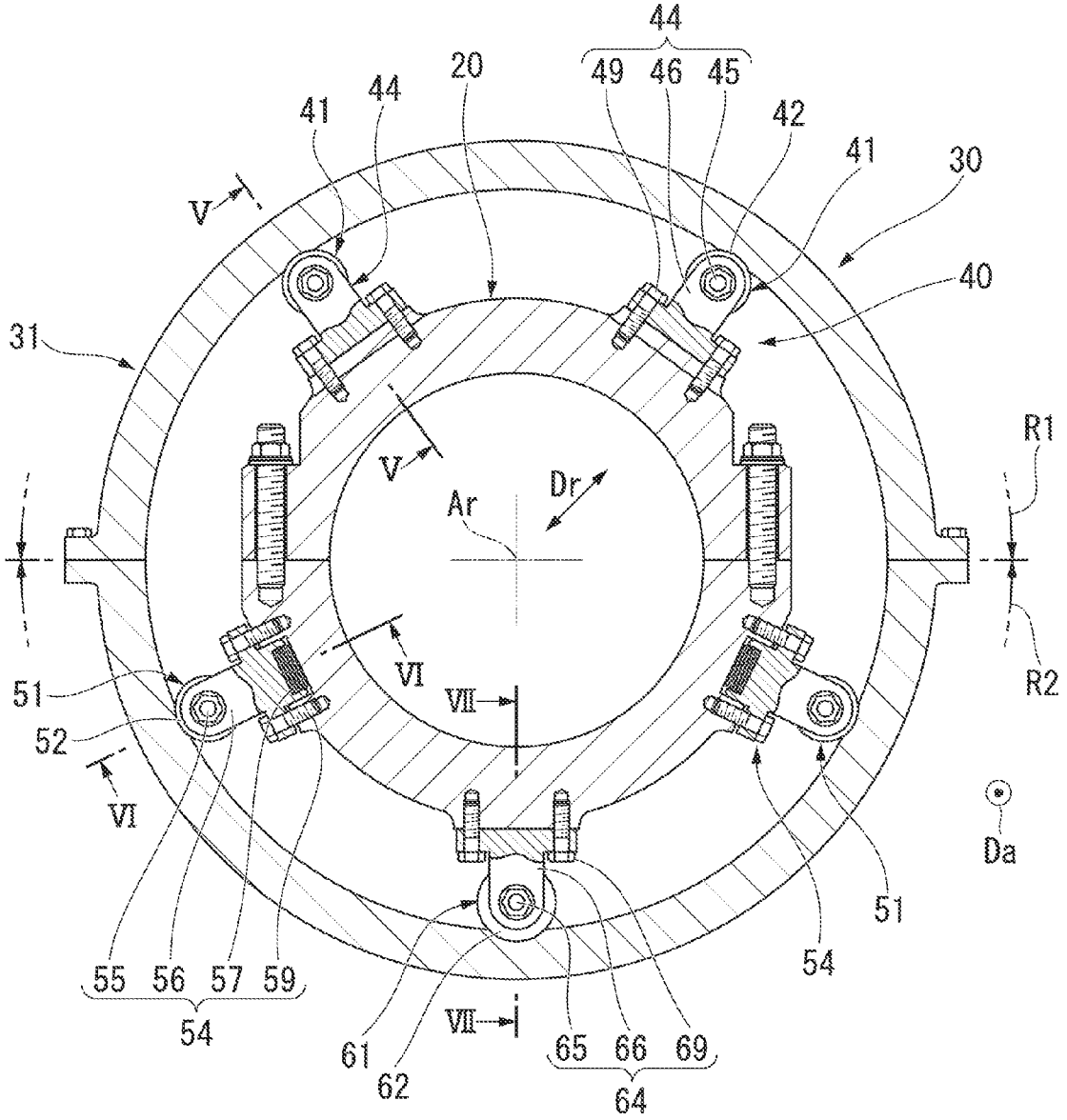
FIG. 3 is a cross-sectional view taken along line III-III of FIG. 1.
Figure 4:
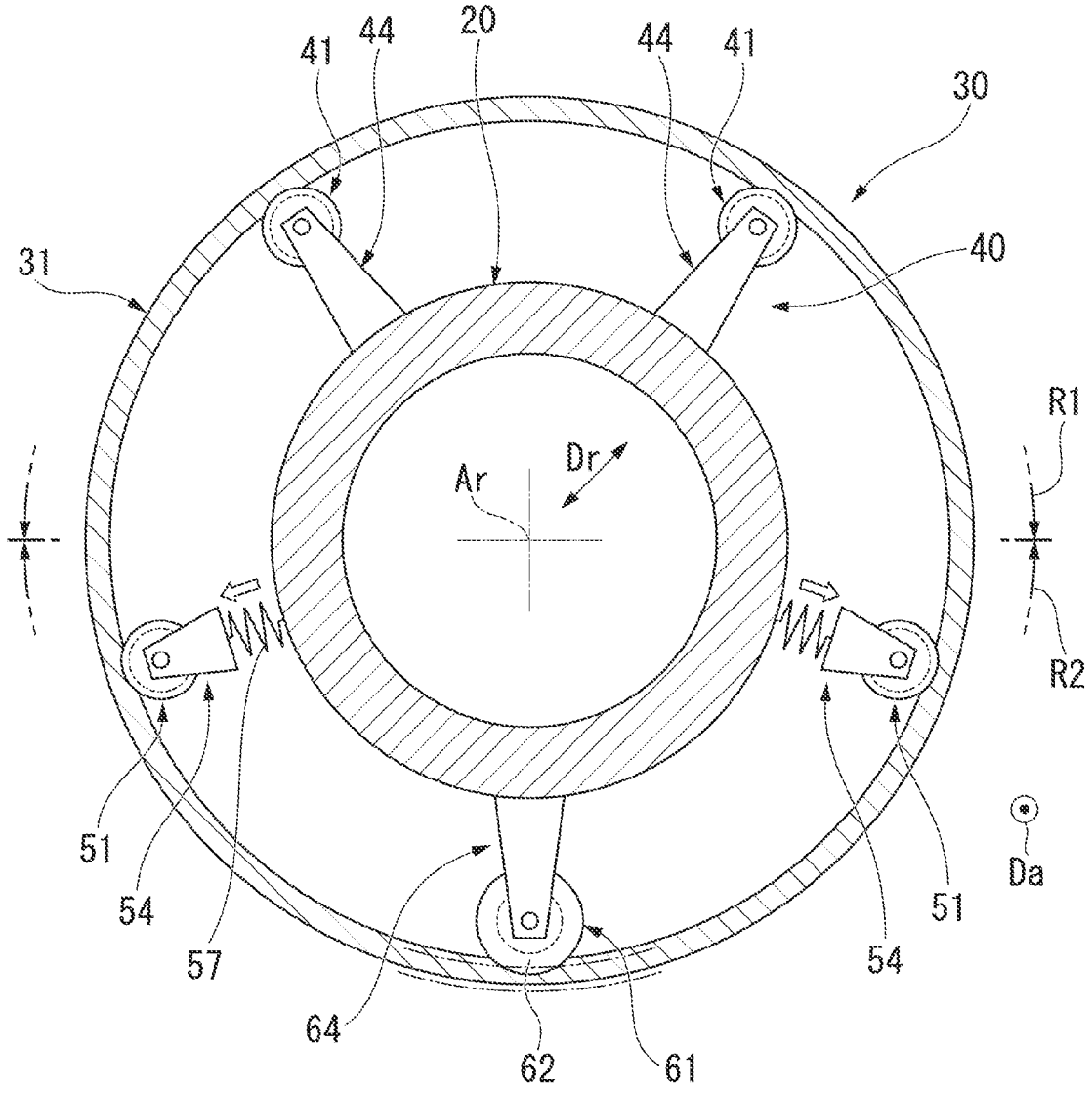
FIG. 4 is a schematic cross-sectional view of the variable vane drive device according to the first embodiment in accordance with the present invention.

As shown in FIGS. 3 and 4, the ring support unit 40 includes two first rollers 41, a first support part 44, two second rollers 51, a second support part 54, one third roller 61, and a third support part 64. The two first rollers 41 make a rolling contact with the movable ring 31. The first support part 44 supports the first roller 41 so as to be relatively immovable with respect to the vane holding ring 20 in the axial direction Da and a radial direction Dr. The two second rollers 51 make a rolling contact with the movable ring 31. The second support part 54 supports the second roller 51 so as to be relatively movable with respect to the vane holding ring 20 in the radial direction Dr, and presses the second roller 51 in a direction in which the movable ring 31 is pressed against the first roller 41, i.e., the radial direction Dr. The one third roller 61 is disposed in such a way that a space is secured between the third roller 61 and the movable ring 31 in the radial direction Dr, and has a pair of flange parts 62 which sandwiches a portion of the movable ring 31 in the axial direction Da. The third support part 64 supports the third roller 61 so as to be relatively immovable with respect to the vane holding ring 20 in the axial direction Da and the radial direction Dr. Note that, the first support part 44 supports the first roller 41 so as to be relatively immovable with respect to the vane holding ring 20 in the axial direction Da and a radial direction Dr, when the vane holding ring and the movable ring thermally expand in the axial direction Da and the radial direction Dr, means that relative positional relations in the axial direction Da and the radial direction Dr of the vane holding ring and the movable ring, which are thermally expanded, and the first roller 41 remain the same. This also applies similarly to the second roller 51 and the third roller 61.

The first roller 41, the second roller 51 and the third roller 61 are supported by the support parts 44, 54 and 64, respectively, such that rotation axes of the rollers are parallel to the rotor axis Ar.

The vane holding ring 20 is equally divided into two regions in a circumferential direction thereof, and one region is referred to as a first region R1 and the other region is referred to as a second region R2. The first region R1 is an upper half region of the vane holding ring 20, and the second region R2 is a lower half region of the vane holding ring 20.

The two first rollers 41 are disposed at positions of the outer circumferential side of the first region R1 of the vane holding ring 20 which are line-symmetrical with respect to a vertical line passing through the rotor axis Ar. In addition, the two second rollers 51 are disposed at positions of the outer circumferential side of the second region R2 of the vane holding ring 20 which are line-symmetrical with respect to a vertical line passing through the rotor axis Ar. The one third roller 61 is disposed at a position of the outer circumferential side of the second region R2 of the vane holding ring 20 which is on a vertical line passing through the rotor axis Ar. That is, the third roller 61 is disposed at a vertically lower position of the rotor axis Ar.

Figure 5:
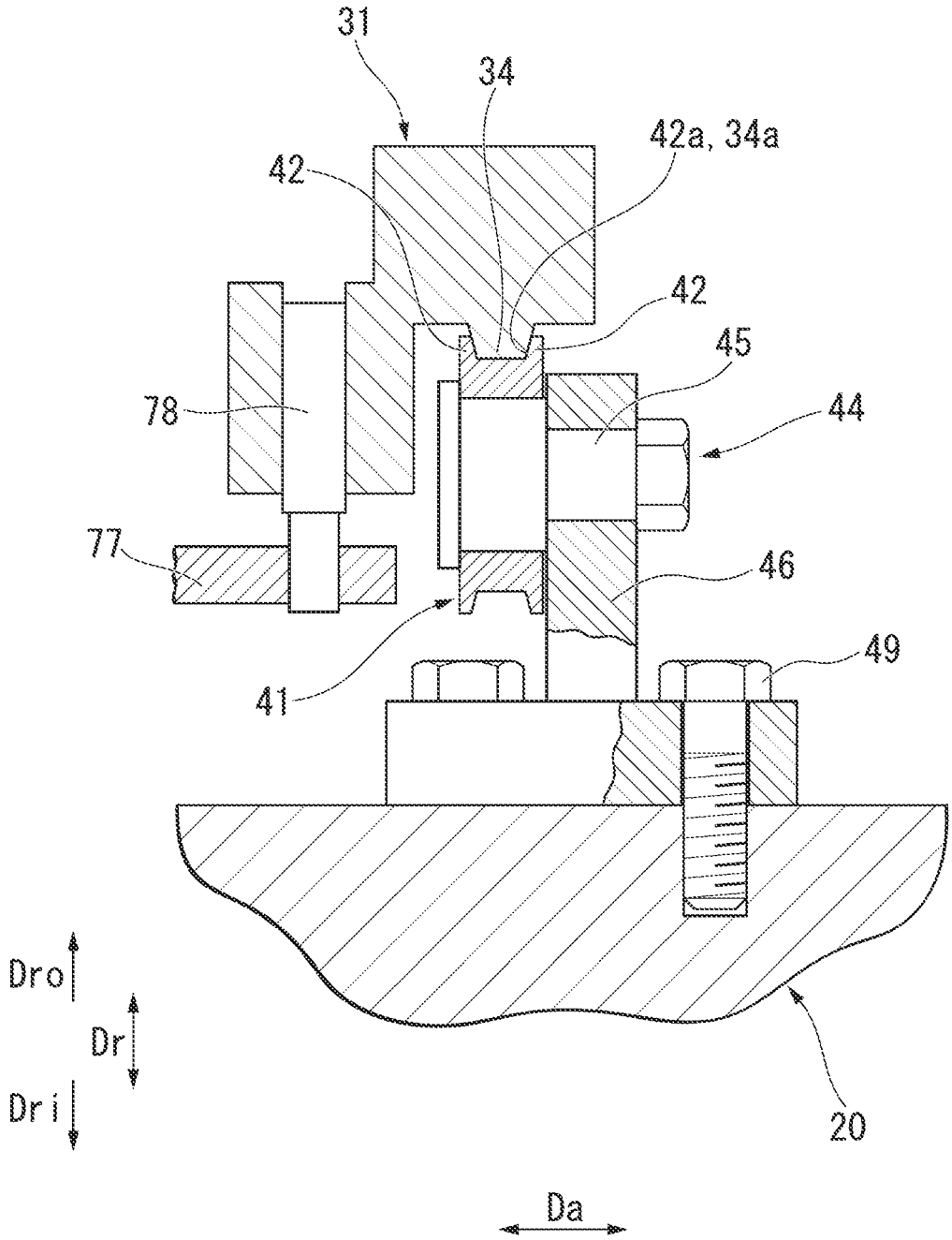
FIG. 5 is a cross-sectional view taken along line V-V of FIG. 3.

As shown in FIGS. 3 and 5, the first roller 41 has a pair of flange parts 42 opposite to each other in the axial direction Da. Opposite surfaces of the pair of flange parts 42 face each other in the axial direction and constitute axial direction restricting surfaces 42*a*. The pair of axial direction restricting surfaces 42*a* is tapered such that a gap between the surfaces is gradually reduced as the surfaces approach a center of the first roller 41. A protruding part 34 protruding to the inside in the radial direction Dri and fitted between the pair of flange parts 42 of the first roller 41 is formed at a portion of the movable ring 31 opposite to the first roller 41. A pair of side surfaces of the protruding part 34 directed in the axial direction Da constitutes opposite surfaces 34*a* opposite to the axial direction restricting surfaces 42*a* of the first roller 41. The pair of opposite surfaces 34*a* is tapered such that a gap between the surfaces is gradually reduced as the surfaces approach the inside in the radial direction Dri.

The first support part 44 configured to support the first roller 41 has a roller shaft 45, a roller support frame 46, and a plurality of bolts 49. The roller shaft 45 passes through a center of the first roller 41 in the axial direction Da, and rotatably supports the first roller 41. The roller support frame 46 supports the roller shaft 45. The plurality of bolts 49 fixes the roller support frame 46 to the vane holding ring 20. Here, while the roller shaft 45 rotatably supports the first roller 41, the roller shaft 45 may be fixed to the first roller 41 and the roller shaft 45 may be rotatably supported by the roller support frame 46.

Figure 6:
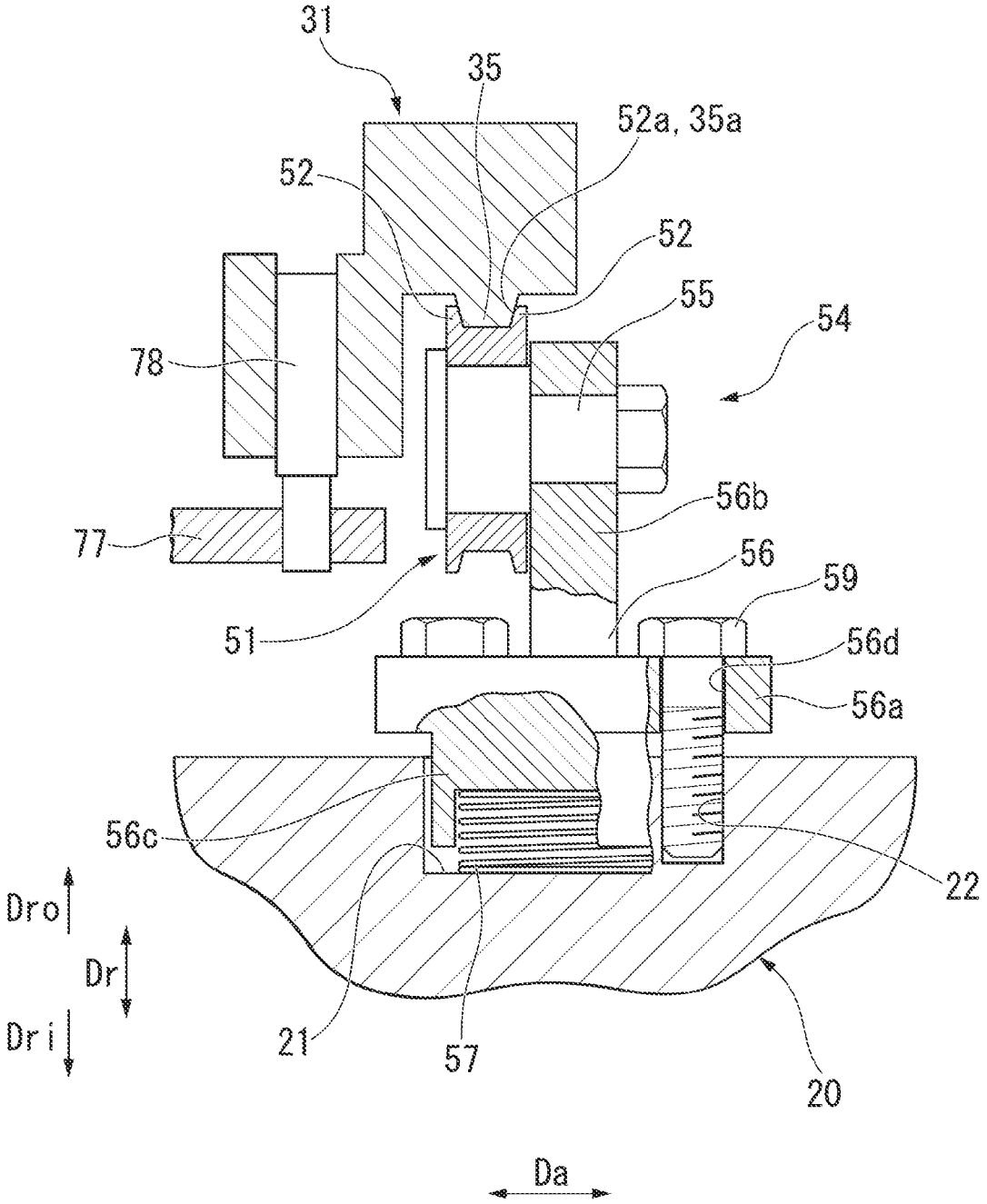
FIG. 6 is a cross-sectional view taken along line VI-VI of FIG. 3.

As shown in FIGS. 3 and 6, the second roller 51 is the same roller as the first roller 41. That is, the second roller 51 also has a pair of flange parts 52 opposite to each other in the axial direction Da. In addition, the opposite surfaces of the pair of flange parts 52 are also tapered as axial direction restricting surfaces 52*a*, similar to the axial direction restricting surfaces 42*a* of the first roller 41. A protruding part 35 protruding to the inside in the radial direction Dri and fitted between the pair of flange parts 52 of the second roller 51 is formed at a portion of the movable ring 31 opposite to the second roller 51. A pair of side surfaces of the protruding part 35 directed in the axial direction Da is also tapered as opposite surfaces 35*a* opposite to the axial direction restricting surfaces 52*a* of the second roller 51.

The second support part 54 configured to support the second roller 51 includes a roller shaft 55, a roller support frame 56, a plurality of bolts 59, and a coil spring 57. The roller shaft 55 passes through a center of the second roller 51 in the axial direction Da, and rotatably supports the second roller 51. The roller support frame 56 supports the roller shaft 55. The plurality of bolts 59 allows relative movement of the roller support frame 56 with respect to the vane holding ring 20 in the radial direction Dr and restricts movement in the other direction. The coil spring 57 presses the roller support frame 56 toward the outside in the radial direction Dro.

The roller support frame 56 has a base plate part 56*a*, a roller shaft support part 56*b*, and a guided convex part 56*c*. The base plate part 56*a* abuts the outer circumferential surface of the vane holding ring 20. The roller shaft support part 56*b* is vertically formed from the base plate part 56*a* in the radial direction Dr. The guided convex part 56*c* protrudes from the base plate part 56*a* to the opposite side of the roller shaft support part 56*b*. A bolt insertion hole 56*d* into which a shaft part of the bolt 59 is inserted is formed in the base plate part 56*a*. The roller shaft 55 is inserted into the roller shaft support part 56*b* and fixed thereto.

A guide hole 21 is formed in a portion of the vane holding ring 20 to which the roller support frame 56 is attached. The guide hole 21 is concaved from the outside in the radial direction Dro to the inside in the radial direction Dri, the guided convex part 56*c* of the roller support frame 56 has an interval from the guide hole 21, and the guided convex part 56*c* of the roller support frame 56 can move in and out of the guide hole 21. Because of the interval, the roller support frame 56 can move with respect to the vane holding ring 20 in the axial direction Da. The coil spring 57 is disposed between a bottom surface of the guide hole 21 and the guided convex part 56*c* of the roller support frame 56.

The bolt 59 has a shaft part inserted into the bolt insertion hole 56*d* of the base plate part 56*a*, and is screwed into a female screw hole 22 formed around the guide hole 21 of the vane holding ring 20. An interval between a bolt head part of the bolt 59 and an outer circumferential surface of the vane holding ring 20 is larger than a thickness of the base plate part 56*a* of the roller support frame 56 in the radial direction. For this reason, the roller support frame 56 is movable over a distance in the radial direction Dr by a difference between the interval, which is between the bolt head part and the outer circumferential surface of the vane holding ring 20, and the thickness of the base plate part 56*a*. In addition, the roller support frame 56 is pressed toward the outside in the radial direction Dro by the coil spring 57.

Accordingly, the second roller 51 is movably supported by the second support part 54 in the radial direction Dr and the axial direction Da, and pressed toward the outside in the radial direction Dro.

Figure 7:
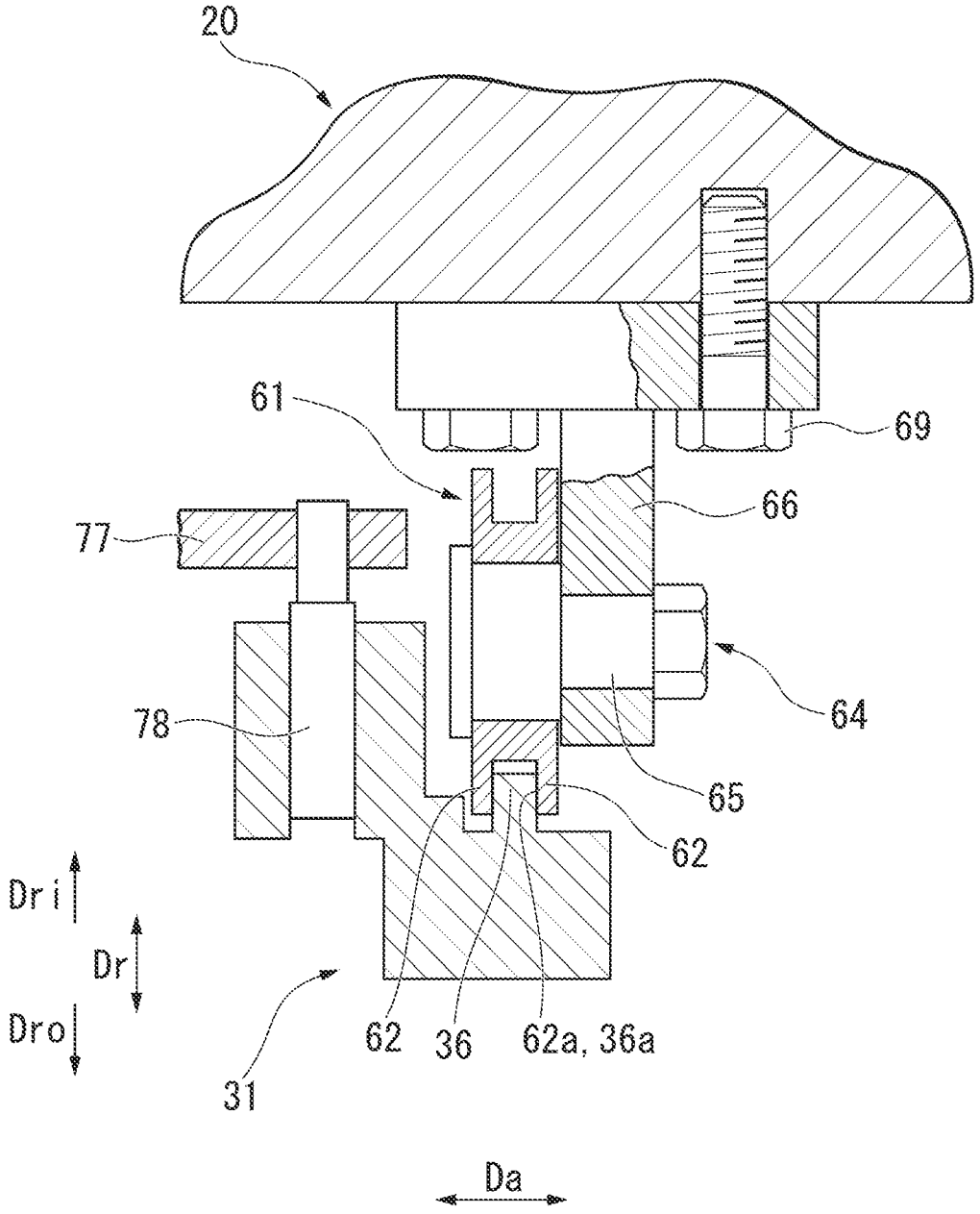
FIG. 7 is a cross-sectional view taken along line VII-VII of FIG. 3.

As shown in FIGS. 3 and 7, the third roller 61 has the pair of flange parts 62 opposite to each other in the axial direction Da. Opposite surfaces of the pair of flange parts 62 form axial direction restricting surfaces 62*a*. The pair of axial direction restricting surfaces 62*a* is perpendicular to a rotation axis of the third roller 61, i.e., perpendicular to the axial direction Da, and is parallel to each other. A protruding part 36 protruding to the inside in the radial direction Dri and fitted between the pair of flange parts 62 of the third roller 61 is formed at a portion of the movable ring 31 opposite to the third roller 61. A pair of side surfaces of the protruding part 36 directed to the axial direction Da form opposite surfaces 36*a* opposite to the axial direction restricting surfaces 62*a* of the third roller 61. The pair of opposite surfaces 36*a* is perpendicular to the axial direction Da and parallel to each other. In addition, the opposite surfaces of the third roller 61 and the movable ring 31 in the radial direction Dr are not in contact with each other. For this reason, the movable ring 31 is relatively movable in the radial direction Dr, but is relatively immovable in the axial direction Da with respect to the third roller 61.

The third support part 64 configured to support the third roller 61 includes a roller shaft 65, a roller support frame 66, and a plurality of bolts 69. Similar to the first support part 44, the roller shaft 65 passes through a center of the third roller 61 in the axial direction Da, and rotatably supports the third roller 61. The roller support frame 66 supports the roller shaft 65. The plurality of bolts 69 fixes the roller support frame 66 to the vane holding ring 20.

In the booster compressor, which is the axial-flow fluid machine C of the embodiment, upon startup, when the gas having a temperature increased by compression of the primary compressor flows into the casing 25, the gas comes in contact with the movable ring 31 and heats the movable ring 31. The gas further flows into the vane holding ring 20, is pressurized by rotation of the rotor 10, and further increases in temperature. For this reason, a temperature of the vane holding ring 20 begins to increase with a delay after the beginning of an increase in temperature of the movable ring 31. Accordingly, upon startup, a temperature difference between the movable ring 31 and the vane holding ring 20 varies according to a lapse of time, and the temperature difference becomes largest. When the booster compressor is started and a predetermined time elapses to be in a steady state, the relationship between the temperature of the movable ring 31 and the temperature of the vane holding ring 20 is reversed. That is, the temperature of the vane holding ring 20 becomes higher and the temperature difference is reduced in comparison with that upon startup, and the temperature difference becomes substantially constant. In addition, upon shutdown, the temperature of the vane holding ring 20 begins to decrease after the temperature of the movable ring 31 begins to decrease. For this reason, even upon shutdown, similar to upon startup, the temperature difference between the movable ring 31 and the vane holding ring 20 varies according to a lapse of time, and the temperature difference becomes a maximum value.

When there is a temperature difference between the vane holding ring 20 and the movable ring 31, a thermal expansion difference between the vane holding ring 20 and the movable ring 31 occurs, and a difference between change in the diameter of the vane holding ring 20 and change in the diameter of the movable ring 31 occurs due to the thermal expansion. When the change in the diameter of the vane holding ring 20 is different from the change in the diameter of the movable ring 31, an overload is applied to the ring support unit 40 rotatably supporting the movable ring 31, or the movable ring 31 comes off from the ring support unit 40. Accordingly, the movable ring 31 cannot be stably and smoothly rotated.

Here, in the embodiment, the first roller 41 configured to restrict relative movement of the movable ring 31 in the axial direction Da and the radial direction Dr is disposed at the outer circumferential side of the first region R1, which is the upper half of the movable ring 31, and the second roller 51 and the third roller 61 configured to allow relative movement of the movable ring 31 in the radial direction Dr are disposed at the outer circumferential side of the second region R2, which is the lower half region of the movable ring 31, so that a lower portion of the movable ring 31 can move downward. Further, in the embodiment, in order to realize restriction of the relative movement of the movable ring 31 in the axial direction Da and the radial direction Dr by the first roller 41, the movable ring 31 is pressed by the second roller 51 in a direction including a vertically downward element in which the movable ring 31 can move, and a contact pressure between the first roller 41 and the movable ring 31 is secured.

Accordingly, in the embodiment, even when the thermal expansion difference between the vane holding ring 20 and the movable ring 31 occurs due to the temperature difference between the vane holding ring 20 and the movable ring 31, and the change in the diameter of the vane holding ring 20 is different from the change in the diameter of the movable ring 31, it is possible to prevent overload from being applied to the ring support unit 40 rotatably supporting the movable ring 31, and the movable ring 31 from coming off from the ring support unit 40. Accordingly, the movable ring 31 can be stably and smoothly rotated.

In addition, in the embodiment, even when a difference between the change in the diameter of the vane holding ring 20 and the change in the diameter of the movable ring 31 due to thermal expansion occurs, since the contact pressure between the movable ring 31 and the first roller 41 is secured, the pair of opposite surfaces (tapered surfaces) 34*a* in the protruding part 34 of the movable ring 31 is in contact with the pair of axial direction restricting surfaces (tapered surfaces) 62*a* of the first roller 41, and the relative movement of the movable ring 31 with respect to the first roller 41 in the axial direction Da can be restricted. Further, in the embodiment, since all of the pair of axial direction restricting surfaces 62*a* of the third roller 61 and the pair of opposite surfaces 36*a* of the protruding part 36 of the movable ring 31 opposite thereto are the surfaces perpendicular to the axial direction Da, even when a difference between the change in the diameter of the vane holding ring 20 and the change in the diameter of the movable ring 31 due to thermal expansion occurs, and the movable ring 31 relatively moves with respect to the third roller 61 in the radial direction Dr, the relative movement of the movable ring 31 with respect to the third roller 61 in the axial direction Da can be restricted. That is, in the embodiment, even when a difference between the change in the diameter of the vane holding ring 20 and the change in the diameter of the movable ring 31 due to thermal expansion occurs, the relative movement of the movable ring 31 in the axial direction Da is restricted by the two first rollers 41, the relative movement of the movable ring 31 in the axial direction Da is restricted by the one third roller 61, and the movement in the axial direction Da over the entire circumference of the movable ring 31 is restricted.

Now, when the movable ring 31 moves in the axial direction Da, since a distance in the axial direction Da between the movable ring 31 and the respective variable vanes 16 changes and a state of the driving force transmission unit 75 connecting the movable ring 31 to the variable vane 16 changes, the respective variable vanes 16 cannot be set to a target vane angle. However, in the embodiment, as described above, since the movement of the movable ring 31 in the axial direction Da over the entire circumference of the movable ring 31 is restricted, the distance in the axial direction Da between the variable vanes 16 and 18 and the movable ring 31 can be uniformly maintained, and the respective variable vanes 16 can be set to a target vane angle.

As described above, in the embodiment, smooth rotation of the movable ring 31 can be secured and the angle of the respective variable vanes 16 can be set to a target vane angle.

[Second Embodiment]

Figure 8:
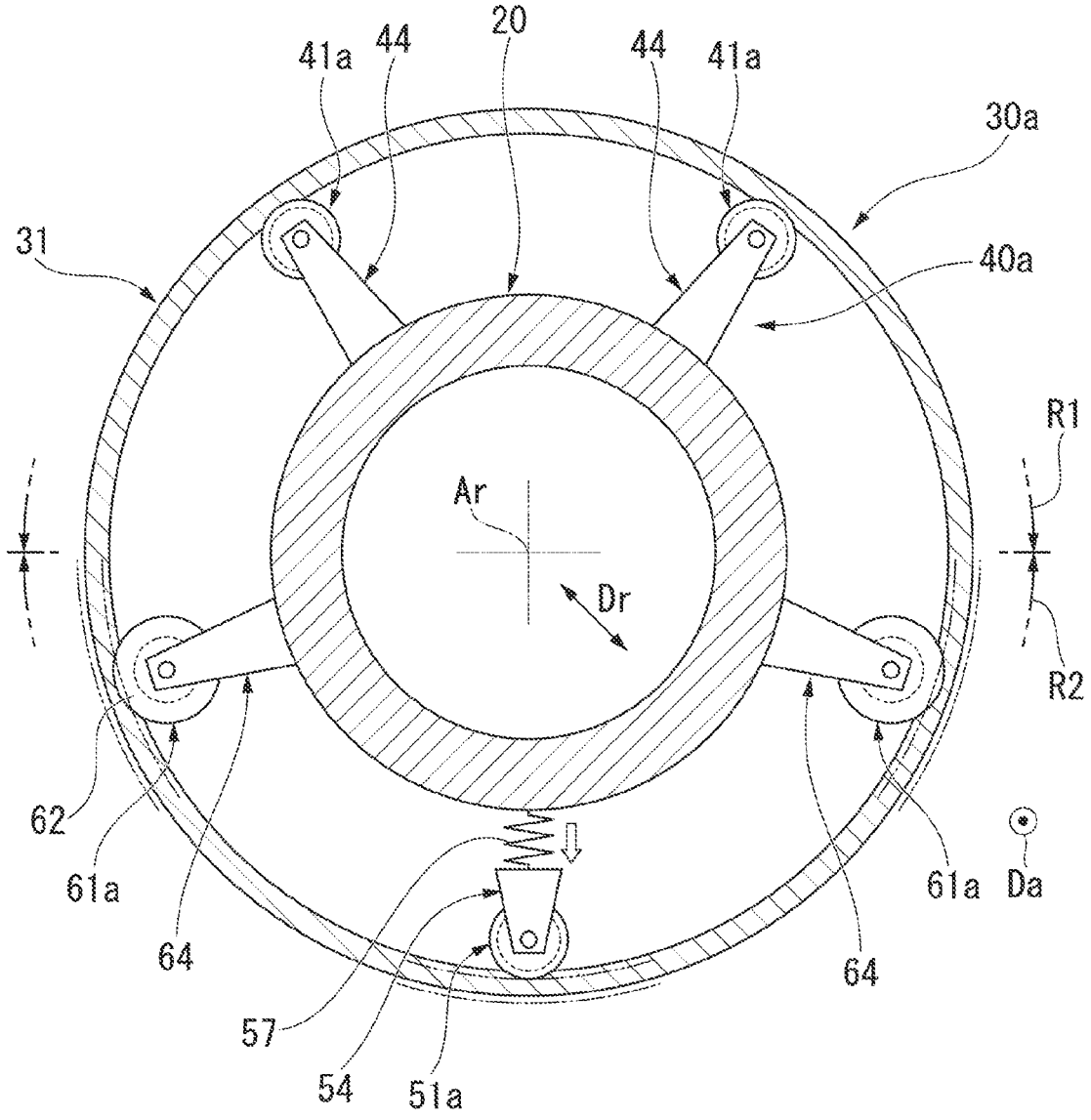
FIG. 8 is a schematic cross-sectional view of a variable vane drive device according to a second embodiment in accordance with the present invention.

Next, a second embodiment of axial-flow fluid machine according to the present invention will be described with reference to FIG. 8.

In the axial-flow fluid machine of the embodiment, the number and disposition of the rollers 41, 51 and 61 of the axial-flow fluid machine of the first embodiment are changed, and the other configurations are basically the same as the axial-flow fluid machine of the first embodiment. Hereinafter, the number and disposition of the rollers 41*a*, 51*a* and 61*a* of the axial-flow fluid machine of the embodiment will be described in detail, and description of other matters will be basically omitted.

The variable vane drive device 30*a* of the axial-flow fluid machine of the embodiment includes two first rollers 41*a*, one second roller 51*a*, and two third rollers 61*a*.

Similar to the first embodiment, the two first rollers 41*a* are disposed at positions of the outer circumferential side of the first region R1 of the vane holding ring 20 which are line-symmetrical with respect to a vertical line passing through the rotor axis Ar. In addition, the one second roller 51*a* is disposed at a position of the outer circumferential side of the second region R2 of the vane holding ring 20 which is on a vertical line passing through the rotor axis Ar. That is, the second roller 51*a* is disposed at a vertically lower position of the rotor axis Ar. The two third rollers 61*a* are disposed at positions of the outer circumferential side of the second region R2 of the vane holding ring 20 which are line-symmetrical with respect to a vertical line passing through the rotor axis Ar.

That is, the variable vane drive device 30*a* of the embodiment has positions of the second roller 51 and the third roller 61 reversed from those of the first embodiment.

Also in the embodiment, similar to the first embodiment, the first roller 41*a* configured to restrict relative movement of the movable ring 31 in the axial direction Da and the radial direction Dr is disposed at the outer circumferential side of the first region R1, which is the upper half region of the movable ring 31, and the second roller 51*a* and the third roller 61*a* configured to allow relative movement of the movable ring 31 in the radial direction Dr are disposed at the outer circumferential side of the second region R2, which is the lower half region of the movable ring 31, so that a lower portion of the movable ring 31 can move downward. Further, also in the embodiment, in order to realize restriction of the relative movement of the movable ring 31 in the axial direction Da and the radial direction Dr by the first roller 41*a*, the movable ring 31 is pressed by the second roller 51*a* in a direction including a vertically downward element in which the movable ring 31 can move, and a contact pressure between the first roller 41*a* and the movable ring 31 is secured.

Accordingly, also in the embodiment, similar to the first embodiment, even when a difference between change in the diameter of the vane holding ring 20 and change in the diameter of the movable ring 31 due to thermal expansion occurs by a temperature difference between the vane holding ring 20 and the movable ring 31, it is possible to prevent an overload from being applied to the ring support unit 40*a* rotatably supporting the movable ring 31, and the movable ring 31 from coming off from the ring support unit 40*a*. Accordingly, the movable ring 31 can be stably and smoothly rotated.

Further, also in the embodiment, since movement of the movable ring 31 in the axial direction Da over the entire circumference of the movable ring 31 is restricted, a distance in the axial direction Da between the respective variable vanes 16 and the movable ring 31 can be uniformly maintained, and the respective variable vanes 16 can be set to a target vane angle.

[Third Embodiment]

Figure 9:
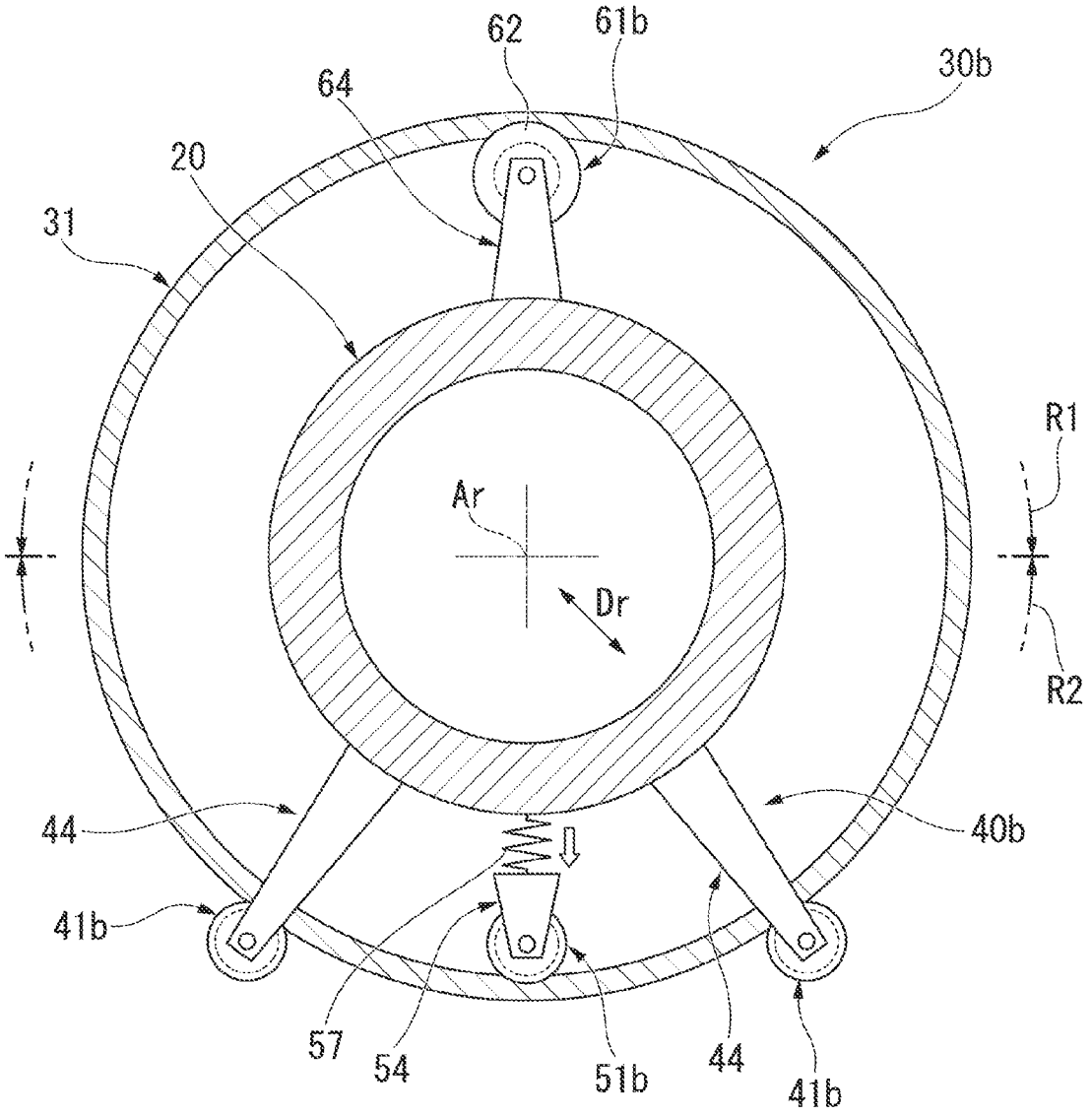
FIG. 9 is a schematic cross-sectional view of a variable vane drive device according to a third embodiment in accordance with the present invention.

Next, a third embodiment of the axial-flow fluid machine according to the present invention will be described with reference to FIG. 9.

The axial-flow fluid machine of the embodiment has a configuration in which the number and disposition of the respective rollers of the axial-flow fluid machine of the first and second embodiments are changed, and the other configurations are basically the same as the axial-flow fluid machine of the first and second embodiments. Hereinafter, the number and disposition of the rollers 41*b*, 51*b* and 61*b* of the axial-flow fluid machine of the embodiment will be described in detail, and description of other matters will be basically omitted.

Similar to the first embodiment, a variable vane drive device 30*b* of the axial-flow fluid machine of the embodiment includes two first rollers 41*b*, one second roller 51*b*, and one third roller 61*b*.

The two first rollers 41*b* are disposed at positions of the outer circumferential side of the second region R2, which is the lower half of the vane holding ring 20 and the outer circumferential side of the movable ring 31, and line-symmetrical with respect to a vertical line passing through the rotor axis Ar. The one second roller 51*b* is disposed at a position of the outer circumferential side of the second region R2 of the vane holding ring 20 and the inner circumferential side of the movable ring 31, and on a vertical line passing through the rotor axis Ar. The one third roller 61*b* is disposed at a position of the outer circumferential side of the first region R1, which is the upper half of the vane holding ring 20 and the inner circumferential side of the movable ring 31, and on a vertical line passing through the rotor axis Ar.

As described above, also in the embodiment, similar to the first and second embodiments, smooth rotation of the movable ring 31 can be secured and the respective variable vanes 16 can be set to a target vane angle while preventing overload from being applied to the ring support unit 40*b*.

In addition, in the embodiment, while the first roller 41*b* is disposed at the outer circumferential side of the movable ring 31, the third roller 61*b* may also be disposed at the outer circumferential side of the movable ring 31. Further, the second roller 51*b* may also be disposed at the outer circumferential side of the movable ring 31. However, in this case, a direction of a pressing force of the second roller 51*b* by the coil spring 57 of the second support part 54 should be reversed from that of the above-mentioned embodiments. Furthermore, also in the first and second embodiments, the first rollers 41 and 41*a*, the second rollers 51 and 51*a*, and the third rollers 61 and 61*a* may be disposed at the outside of the movable ring 31.

In addition, in the above-mentioned embodiments, a vertical relation of the respective rollers with respect to the rotor axis Ar may be reversed.

Further, in both of the above-mentioned embodiments, while the pair of flange parts is formed at the roller side and the protruding part entering between the pair of flange parts is formed at the side of the movable ring 31, conversely, the pair of flange parts may be formed at the side of the movable ring 31 and the protruding part entering between the pair of flange parts may be formed at the side of the roller. Furthermore, the protruding part entering between the pair of flange parts may not be a convex shape. For example, when the protruding part is formed at the side of the roller, if the entire width of the roller in a direction in which the rotary shaft of the roller extends is a width between the pair of flange parts, even though a convex shape is not formed at the side of the outer circumferential of the roller, the outer circumferential side portion of the roller becomes the protruding part as it is.

In addition, while the axial-flow fluid machine of all of the above-mentioned embodiments is the booster compressor, the axial-flow fluid machine may be a conventional compressor configured to compress an atmospheric pressure gas. In this case, the casing of the compressor configures the vane holding ring.

Further, while the axial-flow fluid machine of all of the above-mentioned embodiments is a compressor configured to compress a gas, the present invention is not limited thereto but may be applied to other axial-flow fluid machine C such as a turbine or the like.

Industrial Applicability

In the present invention, even when the thermal expansion difference occurs between the vane holding ring and the movable ring and a difference between the change in a diameter of the vane holding ring and the change in a diameter of the movable ring due to thermal expansion occurs, smooth rotation of the movable ring can be secured and the variable vane can be set to a target vane angle.

[Description of Reference Numerals]

10 rotor
11 rotor main body
12 blade
16 variable vane
20 vane holding ring
25 casing
26 suction port
27 ejection port
30, 30*a*, 30*b* variable vane drive device
31 movable ring
34, 35, 36 protruding part
34*a*, 35*a*, 36*a* opposite surfaces
40, 40*a*, 40*b* ring support unit
41, 41*a*, 41*b* first roller
42, 52, 62 flange part
42*a*, 52*a*, 62*a* axial direction restricting surface
44 first support part
51, 51*a*, 51*b* second roller
54 second support part
57 coil spring
61, 61*a*, 61*b* third roller
64 third support part
70 rotary drive unit
75 driving force transmission unit

What is claimed is:

1. A variable vane drive device of an axial-flow fluid machine comprising:

a movable ring which is in an annular shape and provided along an outer circumferential side of a plurality of variable vanes disposed annularly;

a vane holding ring which encloses the outer circumferential side of the plurality of variable vanes and holds the plurality of variable vanes;

a ring support unit which rotatably supports the movable ring with respect to the vane holding ring; and a driving force transmission unit, which includes a vane rotary shaft, a link piece, and a Connecting pin, and which connects the movable ring and the plurality of variable vanes in such a way that an angle of the plurality of variable vanes is changed by rotation of the movable ring, wherein the ring support unit comprises:

a plurality of first rollers which makes a rolling contact with the movable ring;

a first support part which supports the first rollers so as to be relatively immovable with respect to the vane holding ring in a radial direction and in an axial direction of the vane holding ring;

one or more second rollers which make rolling contact with the movable ring;

a second support part which supports the second rollers so as to be relatively movable with respect to the vane holding ring in the radial direction, and presses the second rollers in the radial direction toward a side at which the movable ring is pressed against the first roller;

one or more third rollers which are disposed in such a way that a space is secured between the third rollers and the movable ring in the radial direction, allow relative movement of the movable ring in the radial direction, and restrict relative movement of the movable ring in the axial direction; and a third support part which supports the third rollers so as to be relatively immovable with respect to the vane holding ring in the axial direction and in the radial direction.

2. The variable vane drive device of the axial-flow fluid machine according to claim 1, wherein a protruding part protruding from the movable ring to the third rollers, a pair of flange parts sandwiching the protruding part in the axial direction is formed at the third rollers, a pair of side surfaces of the protruding part directed to the axial direction forms surfaces perpendicular to the axial direction, and the pair of flange parts formed at the third rollers has a pair of surfaces facing each other and perpendicular to the axial direction.

3. The variable vane drive device of the axial-flow fluid machine according to claim 1, wherein the first rollers restrict relative movement of the movable ring in the axial direction.

4. The variable vane drive device of the axial-flow fluid machine according to claim 1, wherein the second rollers restrict relative movement of the movable ring in the axial direction, and the second support part supports the second rollers so as to be relatively immovable with respect to the vane holding ring in the axial direction.

5. The variable vane drive device of the axial-flow fluid machine according to claim 1, wherein when the vane holding ring is equally divided into a first region and a second region in a circumferential direction, the plurality of first rollers is disposed at an outer circumferential side of the first region, and the third rollers are disposed at an outer circumferential side of the second region.

6. The variable vane drive device of the axial-flow fluid machine according to claim 5, wherein two first rollers are provided, a first one of the two first rollers is disposed at one side of the first region in a circumferential direction thereof, and a second one of the two first rollers is disposed at the other side of the first region in the circumferential direction.

7. The variable vane drive device of the axial-flow fluid machine according to claim 5, wherein two second rollers are provided, a first one of the two second rollers is disposed at one side of the second region in a circumferential direction thereof, and a second one of the two second rollers is disposed at the other side of the second region in the circumferential direction.

8. The variable vane drive device of the axial-flow fluid machine according to claim 5, wherein the third roller is disposed in the second region and on an extension line of a line of action of resultant force of supporting forces of the plurality of first rollers with respect to the movable ring in the radial direction.

9. The variable vane drive device of the axial-flow fluid machine according to claim 5, wherein an axis of the vane holding ring extends in a horizontal direction, the first region is upper half region with reference to the axis, and the second region is the lower half region with reference to the axis.

10. An axial-flow fluid machine comprising:

the variable vane drive device according to claim 1;

the vane holding ring;

a rotor disposed inside of the vane holding ring and having a rotor main body extending in the axial direction and a plurality of blades provided on an outer circumference of the rotor main body; and the plurality of variable vanes disposed at the outer circumferential side of the rotor main body and one side in the axial direction of the plurality of blades.

11. The axial-flow fluid machine according to claim 10, wherein the axial-flow fluid machine is a compressor that compresses a gas by rotation of the rotor.

12. The axial-flow fluid machine according to claim 10, wherein the axial-flow fluid machine is a booster compressor into which a gas compressed by a primary compressor is introduced and in which the gas is further compressed by rotation of the rotor, and the axial-flow fluid machine comprises a casing which covers the outer circumferential side of the vane holding ring and the outer circumferential side of the movable ring, and has a suction port that sucks the gas compressed by the primary compressor and an ejection port that ejects the gas further compressed by rotation of the rotor.

* * * * *